US008968446B1

(12) United States Patent
Mainiero

(10) Patent No.: US 8,968,446 B1
(45) Date of Patent: Mar. 3, 2015

(54) OIL AND AIR SEPARATION SYSTEM AND METHOD

(71) Applicant: UPR Products, Inc., Lake Worth, FL (US)

(72) Inventor: Joseph Mainiero, Lake Worth, FL (US)

( * ) Notice: Subject to any disclaimer, the term of this patent is extended or adjusted under 35 U.S.C. 154(b) by 0 days.

(21) Appl. No.: 14/198,789

(22) Filed: Mar. 6, 2014

(51) Int. Cl.
*B01D 46/00* (2006.01)
*F01N 13/00* (2010.01)

(52) U.S. Cl.
CPC ..... *F01N 13/0093* (2014.06)
USPC ..... 95/287

(58) Field of Classification Search
CPC ..... F01M 2013/0438; F01M 13/04; B01D 46/2411; B01D 46/521; B01D 46/0024; B01D 46/003; B01D 2267/60; B01D 2267/40; B01D 2201/298
See application file for complete search history.

(56) References Cited

U.S. PATENT DOCUMENTS 2,642,052 A * 6/1953 Wagner et al. ..... 123/573
4,487,618 A * 12/1984 Mann ..... 55/323
4,502,955 A * 3/1985 Schaupp ..... 210/149
4,692,175 A * 9/1987 Frantz ..... 96/408
4,865,815 A * 9/1989 Martin et al. ..... 422/122
4,909,937 A * 3/1990 Hoffmann et al. ..... 210/315
5,061,300 A * 10/1991 Alexander, III ..... 95/24
5,277,154 A * 1/1994 McDowell ..... 123/41.86
5,284,997 A * 2/1994 Spearman et al. ..... 588/249
RE35,433 E * 1/1997 Alexander, III ..... 95/24
6,159,259 A * 12/2000 Maeda ..... 55/323
6,248,236 B1 * 6/2001 Hodgkins ..... 210/232
6,254,788 B1 * 7/2001 Davidson ..... 210/764
6,561,171 B2 * 5/2003 Burgess ..... 123/572
8,152,887 B2 * 4/2012 Patel ..... 55/485
8,388,834 B2 * 3/2013 Rosgen et al. ..... 210/117
8,449,637 B2 * 5/2013 Heinen et al. ..... 55/327
8,616,188 B2 * 12/2013 Heckel et al. ..... 123/572
8,741,015 B2 * 6/2014 Schnacke ..... 55/482
2008/0257160 A1 * 10/2008 Yoshida et al. ..... 96/139

FOREIGN PATENT DOCUMENTS

EP 2167218 A2 * 3/2010

* cited by examiner

*Primary Examiner* — Amber Orlando
(74) *Attorney, Agent, or Firm* — Uradnik Law Firm

(57) ABSTRACT

An oil and air separation can includes: (i) a first screen that holds an oil filter assembly proximate a can intake for blow-by gases, and (ii) a second screen that holds a second oil filter assembly proximate a can exhaust for blow-by gases, wherein the first screen and the second screen are spaced vertically apart from one another.

12 Claims, 3 Drawing Sheets

OIL AND AIR SEPARATION SYSTEM AND METHOD

FIELD OF THE DISCLOSURE

The invention relates generally to engine positive crankcase ventilation (PCV) systems and methods for recycling blow-by gases through a PCV valve into the engine's intake manifold, and more particularly in one exemplary embodiment, to systems and methods including an oil and air separator system for removal of crankcase oil from such blow-by gases.

BACKGROUND

In a combustion engine, blow-by gases typically include unburned gasoline. That is, an amount of air and unburned gasoline from the engine cylinder is pulled past the piston rings and into the crankcase. Instead of exhausting such blow-by gases to the atmosphere, a positive crankcase ventilation (PCV) system recycles the blow-by gases through a PCV valve into the engine's intake manifold. Such recycling occurs when the engine is operating at relatively slow speeds (e.g. idling), i.e., when the air pressure in the crankcase is higher than the air pressure in the intake manifold.

One problem associated with PCV systems and their use involves oil vapors. An engine's crankcase is used to store oil. A pan located below the crankshaft holds oil, and generally oil vapors from the oil in the pan may find their way into the blow-by gases.

It is undesirable for oil to be recycled with blow-by gases into an engine's intake manifold. Such oil may degrade engine performance by lowering the overall octane of the combustion mixture in a cylinder. Such oil also may coat the air intake and prevent airflow.

To combat the presence of oil in blow-by gases, oil and air separators were developed to remove the oil from the blow-by gases before recirculation into the intake manifold. There are various different models or types of oil and air separators available, one of which is shown by way of example in FIG. 1. FIG. 1 describes one popular type of oil and air separators that involves passing oily blow-by gases through a filter material. The oil collects in droplets on the filter material, which is held in place by a screen. The oil is allowed to drop into the bottom of a can where the oil collects for later removal.

This "can approach" to oil and air separation, as shown by way of example in FIG. 1, is not without its drawbacks, however. In particular, the screen in the can that helps hold the filter material in place may serve as a pathway along which oil may flow. See FIG. 1. Thus, unwanted oil vapors may become present in the exhaust from the oil and air separator can.

SUMMARY

The present disclosure provides oil and air separation systems and methods. In one exemplary embodiment, an oil and air separation can includes: (i) a first screen that holds an oil filter assembly proximate a can intake for blow-by gases, and (ii) a second screen that holds an oil filter assembly proximate a can exhaust for blow-by gases, wherein the first screen and the second screen are spaced vertically apart from one another.

Other benefits and advantages of the present disclosure will be appreciated from the following detailed description.

DETAILED DESCRIPTION

Embodiments of the invention and various alternatives are described. Those skilled in the art will recognize, given the teachings herein, that numerous alternatives and equivalents exist which do not depart from the invention. It is therefore intended that the invention not be limited by the description set forth herein or below.

One or more specific embodiments of the system and method will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Further, for clarity and convenience only, and without limitation, the disclosure (including the drawings) sets forth exemplary representations of only certain aspects of events and/or circumstances related to this disclosure. Those skilled in the art will recognize, given the teachings herein, additional such aspects, events and/or circumstances related to this disclosure, e.g., additional elements of the devices described; events occurring related to oil and air separation and can use; etc. Such aspects related to this disclosure do not depart from the invention, and it is therefore intended that the invention not be limited by the certain aspects set forth of the events and circumstances related to this disclosure.

Figure 1:
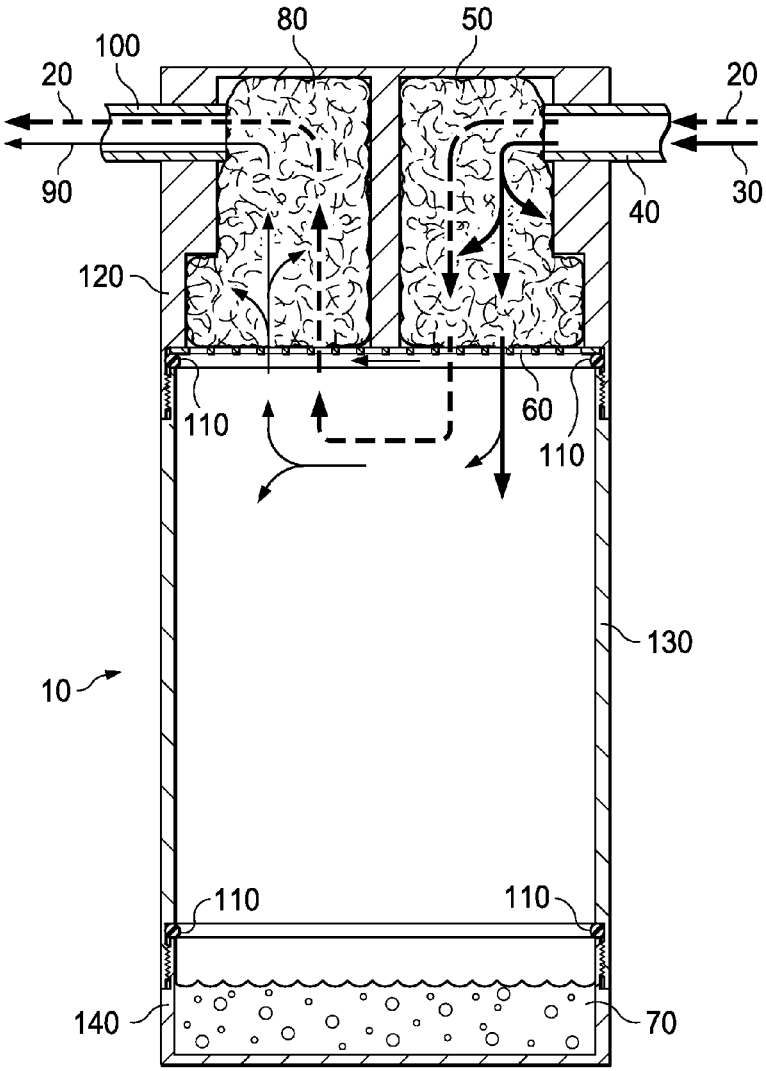
FIG. 1 (PRIOR ART)
FIG. 1 is a cross sectional view of a prior art oil and air separation can.

Turning now to the drawings, FIG. 1 shows an exemplary prior art oil and air separation can 10. Blow-by gas 20 enters the can 10 along with oil vapors 30 at intake port 40. The gases 20 and 30 together are channeled through intake filter material 50. Intake filter material 50 may consist of a stainless steel mesh. Oil from the oily vapors collects on the intake filter material 50, and flows downward to screen 60, e.g., due to gravity. Screen 60 holds the intake filter material 50 in place proximate the intake port 40. Screen 60 also holds exhaust filter material 80 in place proximate the exhaust port 100. One or more rubber o-rings 110 may be used to seal the various portions of the can 10 (i.e., the upper section 120, the middle section 130, and the lower section 140, each removably joined to one or more other sections by threaded engagement).

Oil collects on the screen 60 and drips to form an oil pool 70 in the bottom of the can 10. Oil also may migrate across the surface of the screen 60 and into the exhaust filter material 80, as shown in FIG. 1. From there, blow-by gases 20, as well as oily vapors 90 resulting at least in part from the oil migration across the surface of screen 60, may exit the can 10 at exhaust port 100.

Figure 2:
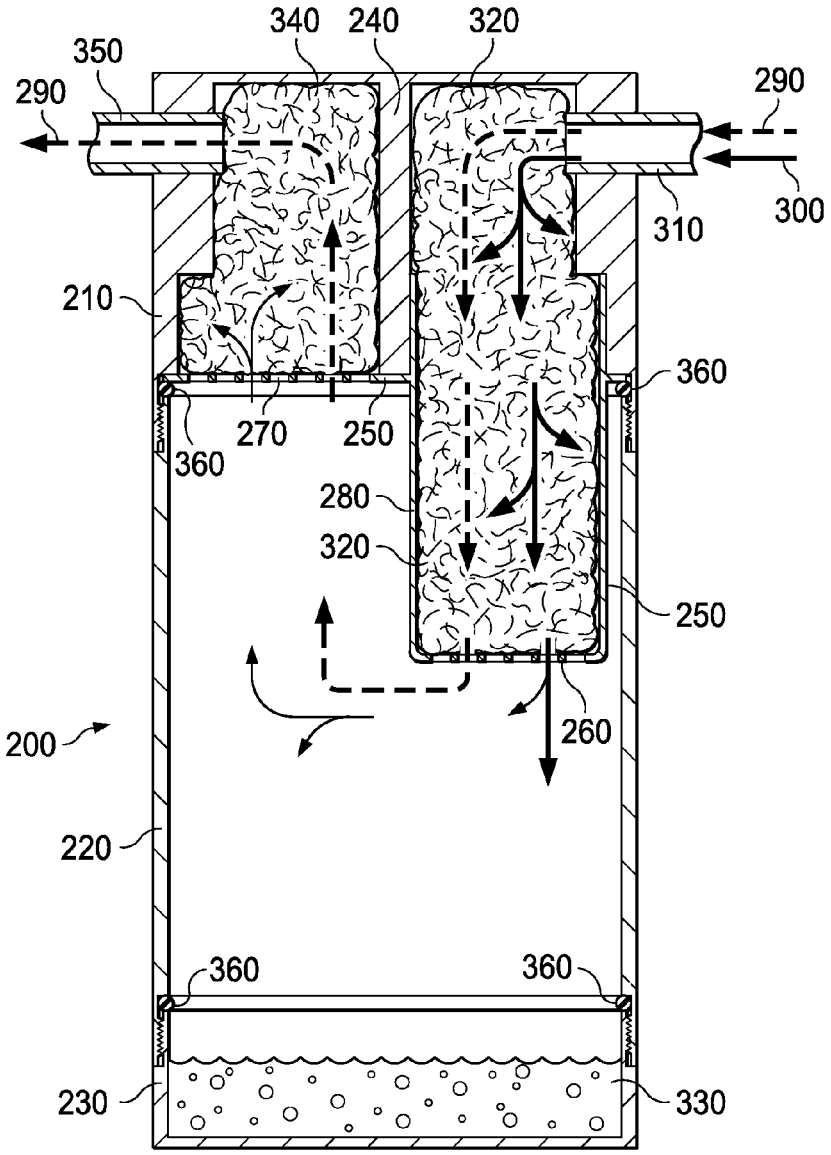
FIG. 2 is an exemplary embodiment of an oil and air separation can including, in one aspect, a first screen and a second screen spaced vertically apart from one another.
Figure 3:
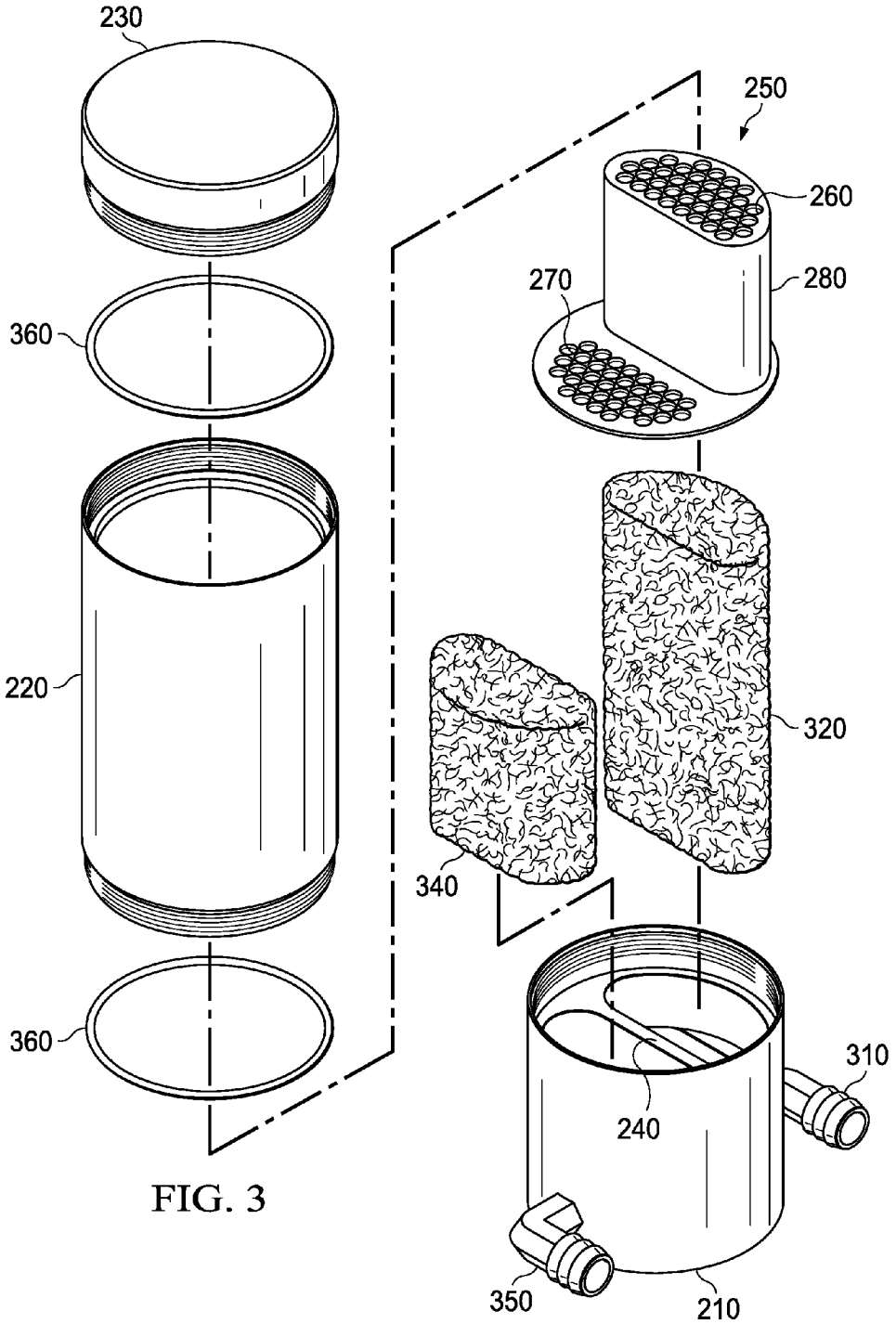
FIG. 3 is an exploded view of the exemplary embodiment of an oil and air separation can shown in FIG. 2.

The oil and air separation can embodiment shown in FIG. 2 addresses the problems associated with the prior art embodiment of FIG. 1, by helping to reduce or eliminate the flow of oil outward through the can exhaust port. As shown in FIG. 2, a can 200 includes an upper portion 210, a middle portion 220, and a bottom portion 230. The middle portion 220 at its upper end is removably coupled by threaded engagement to the lower end of upper portion 210. The middle portion 220 at its lower end is removably coupled by threaded engagement to the upper end of bottom portion 230.

The upper portion 210 includes a divider 240 that generally separates the volume defined by the upper portion 210 into a first intake side and a second exhaust side. A screen assembly 250 comprises a first screen portion 260 generally disposed on, and in fluid communication with, the intake side of upper portion 210, and a second screen portion 270 generally disposed on, and in fluid communication with, the exhaust side of upper portion 210. As shown in FIG. 2, the screen assembly 250 includes extension member 280. Extension member 280 vertically spaces first screen portion 260 apart from second screen portion 270. That is, while second screen portion 270 is generally disposed proximate the entrance to the second exhaust side of upper portion 210, the first screen portion 260 is generally disposed within the volume defined by middle portion 220. Thus, in one aspect, as compared to the prior art embodiment shown in FIG. 1, the extension member 280 in effect defines in part the first intake side and relocates the flow exit from the intake side of upper portion 210 from a first position proximate the lower end of upper portion 210 to a second position within the volume generally defined by middle portion 220.

By vertically spacing first screen portion 260 to a position lower than second screen portion 270, oil which collects on first screen portion 260 is inhibited from migration to second screen portion 270. Thus, the amount of oil entering the exhaust side of upper portion 210 is substantially reduced or eliminated.

The operation of the can 200 involves blow-by gases 290 and oily vapors 300 entering the can 200 at intake port 310. From there, the flow is directed through intake filter material 320, which may include a stainless steel mesh or other suitable oil filtering assembly. Oil collects on the filter material 320 and flows downward to first screen portion 260, e.g., due to gravity. From there, the oil is unable to migrate from first screen portion 260 to second screen portion 270. Oil thus drops from first screen portion 260 (and from second screen portion 270) into an oil pool 330 that forms in the bottom portion 230 of can 200.

Any oil vapors that are present in middle portion 220 of can 200 may be scrubbed of oil by exhaust filter material 340. Thus, most if not all of the flow exiting the can 200 at exhaust port 350 comprises blow-by gas 290.

O-rings, or another suitable sealing assembly 360, may be used to seal the threaded connections between the various portions of can 200. The volume defined by the middle portion 220 and the bottom portion 230 may be adjusted by varying the sizes of those components. In addition, one or more modular can extension portions may be added to the can 200, each resembling middle portion 220, so as to increase or otherwise adjust the overall can volume. It is believed that by increasing the volume of can 200, less oil may enter the exhaust side of can upper portion 210 at second screen portion 270.

In accordance with the description herein, a method of oil and air separation may include providing an oil and air separation can including a first screen that holds an oil filter proximate a can intake for blow-by gases and a second screen that holds an oil filter proximate a can exhaust for blow-by gases, wherein the first screen and the second screen are spaced vertically apart from one another.

Further, in accordance with the description herein, a method of oil and air separation may include providing a screen assembly including a first screen portion vertically spaced from a second screen portion, said screen assembly adapted for installation into an oil and air separator. In that way, prior art oil and air separators may be adapted to gain the advantages associated with the embodiments described herein.

It should be understood that the foregoing description is only illustrative of the invention. Various alternatives and modifications can be devised by those skilled in the art having the benefit of this disclosure, without departing from the invention. Accordingly, the invention is intended to embrace all such alternatives, modifications and variances.

Certain exemplary embodiments of the disclosure may be described. Of course, the embodiments may be modified in form and content, and are not exhaustive, i.e., additional aspects of the disclosure, as well as additional embodiments, will be understood and may be set forth in view of the description herein. Further, while the invention may be susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents and alternatives falling within the spirit and scope of the invention.

What is claimed is:

1. An oil and air separation can for an engine positive crankcase ventilation (PCV) system including: (i) a first screen that holds a coalescing first oil filter assembly between an intake port for blow-by gases and the first screen, and (ii) a second screen that holds a coalescing second oil filter assembly between an exhaust port for blow-by gases and the second screen, wherein the first screen and the second screen are spaced entirely vertically and laterally apart from one another.

2. The oil and air separation can of claim 1, further comprising a screen assembly integrally including the first screen and the second screen.

3. The oil and air separation can of claim 1, wherein the first oil filter assembly comprises stainless steel mesh.

4. The oil and air separation can of claim 1, wherein the second oil filter assembly comprises stainless steel mesh.

5. The oil and air separation can of claim 1, further comprising a chamber at a lower end of the can for collecting oil.

6. The oil and air separation can of claim 5, wherein the first screen is disposed within the chamber.

7. The oil and air separation can of claim 5, wherein the second screen defines a top portion of the chamber.

8. The oil and air separation can of claim 1, wherein the second screen is spaced above the first screen.

9. A filter assembly adapted to fit an oil and air separation can for an engine positive crankcase ventilation (PCV) system including: (i) a first screen holding a coalescing first oil filter assembly between a can intake port for blow-by gases and the first screen, and (ii) a second screen holding a coalescing second oil filter assembly between a can exhaust port for blow-by gases and the second screen, wherein the first screen and the second screen are spaced entirely vertically and laterally apart from one another.

10. The oil and air separation can of claim 9, wherein the second screen is spaced above the first screen.

11. The oil and air separation can of claim 9, wherein the first screen and the second screen are integrally joined by an extension member.

12. The oil and air separation can of claim 11, wherein the extension member is adapted to help prevent the flow of oil on a first surface of the first screen from migrating to a second surface of the second screen.

* * * * *